US009279342B2

(12) United States Patent
Davi et al.

(10) Patent No.: US 9,279,342 B2
(45) Date of Patent: Mar. 8, 2016

(54) TURBINE CASING WITH SERVICE WEDGE

(71) Applicant: General Electric Company, Schenectady, NY (US)

(72) Inventors: Michael Alan Davi, Niskayuna, NY (US); Thomas James Batzinger, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 581 days.

(21) Appl. No.: 13/683,128

(22) Filed: Nov. 21, 2012

(65) Prior Publication Data

US 2014/0140839 A1 May 22, 2014

(51) Int. Cl.
*F01D 25/26* (2006.01)
*F01D 25/24* (2006.01)

(52) U.S. Cl.
CPC ..... *F01D 25/26* (2013.01); *F01D 25/24* (2013.01); *F01D 25/243* (2013.01); *F05D 2230/72* (2013.01); *Y10T 29/49718* (2015.01)

(58) Field of Classification Search
CPC ..... F01D 25/24; F01D 25/243; F01D 25/26
USPC ..... 415/118, 201; 244/53 B, 53 R, 54
See application file for complete search history.

(56) References Cited

U.S. PATENT DOCUMENTS 2,851,214 A * 9/1958 Busquet ..... 415/129
3,741,680 A 6/1973 Killmann et al.
3,917,432 A 11/1975 Feuerstein et al.
3,936,217 A 2/1976 Travaglini et al.
4,011,017 A 3/1977 Feuerstein et al.
4,137,006 A 1/1979 Becker
4,199,301 A * 4/1980 Meylan ..... 415/201
4,208,777 A * 6/1980 Walsh et al. ..... 29/418
4,268,221 A 5/1981 Monsarrat et al.
4,412,782 A 11/1983 Monsarrat
5,273,393 A 12/1993 Jones et al.
5,350,136 A 9/1994 Prosser et al.
5,605,438 A 2/1997 Burdgick et al.
5,755,403 A 5/1998 Marche
5,803,405 A 9/1998 Ellis et al.
5,975,463 A 11/1999 Gruensfelder et al.
6,220,546 B1 4/2001 Klamka et al.
6,336,789 B1 1/2002 Beerens et al.

(Continued)

FOREIGN PATENT DOCUMENTS

EP 0696985 2/1996
EP 1832755 A2 9/2007

(Continued)

OTHER PUBLICATIONS

EP Search Report and Written Opinion dated Feb. 5, 2014, issued in connection with corresponding EP Application No. 13192294.0.

*Primary Examiner* — Igor Kershteyn
*Assistant Examiner* — Woody A Lee, Jr.
(74) *Attorney, Agent, or Firm* — Ernest G. Cusick; Frank A. Landgraff

(57) ABSTRACT

A turbine casing is provided and includes first and second turbine casing shells configured to be removably coupled to one another. At least one of the first and second turbine casing shells is formed to define an access slot. At least one service wedge is configured to be removably installed in the access slot.

14 Claims, 4 Drawing Sheets

(56) References Cited

U.S. PATENT DOCUMENTS

| | | | | |
|---|---|---|---|---|
| 6,375,410 | B2 * | 4/2002 | Clouse et al. | 415/9 |
| 6,471,473 | B1 | 10/2002 | Wilkinson et al. | |
| 6,622,963 | B1 | 9/2003 | Ahrendt et al. | |
| 6,663,047 | B1 | 12/2003 | Arata | |
| 6,691,019 | B2 | 2/2004 | Seeley et al. | |
| 6,868,366 | B1 | 3/2005 | Eisenzopf | |
| 7,255,307 | B2 | 8/2007 | Mayes | |
| 7,326,031 | B2 | 2/2008 | O'Neill et al. | |
| 7,458,768 | B2 | 12/2008 | Dube et al. | |
| 7,503,523 | B2 | 3/2009 | Perez-Sanchez | |
| 7,703,716 | B2 | 4/2010 | Bulin | |
| 7,721,525 | B2 | 5/2010 | Shutrump | |
| 7,726,022 | B2 | 6/2010 | Trbojevic et al. | |
| 7,766,614 | B2 | 8/2010 | Northfield | |
| 7,789,347 | B2 | 9/2010 | Oberle et al. | |
| 7,909,289 | B2 | 3/2011 | Perez-Sanchez | |
| 7,938,359 | B2 | 5/2011 | Guibert et al. | |
| 7,959,106 | B2 | 6/2011 | Guibert et al. | |
| 7,994,940 | B2 | 8/2011 | Grichener et al. | |
| 8,021,109 | B2 | 9/2011 | Kneeland et al. | |
| 8,047,769 | B2 | 11/2011 | Ballard, Jr. | |
| 8,075,261 | B2 | 12/2011 | Merry et al. | |
| 8,109,467 | B2 | 2/2012 | Murphy | |
| 8,128,353 | B2 | 3/2012 | Flanagan et al. | |
| 8,172,528 | B2 | 5/2012 | Kawakami et al. | |
| 8,210,802 | B2 | 7/2012 | Kneeland et al. | |
| 8,210,804 | B2 | 7/2012 | Maier et al. | |
| 8,246,298 | B2 | 8/2012 | Wilson | |
| 8,267,437 | B2 | 9/2012 | Maier | |
| 8,272,595 | B2 | 9/2012 | Ramlaoui et al. | |
| 2007/0212217 | A1 | 9/2007 | Northfield | |
| 2009/0129922 | A1 * | 5/2009 | Cloft et al. | 415/213.1 |
| 2009/0202340 | A1 | 8/2009 | Ballard, Jr. | |
| 2010/0215477 | A1 | 8/2010 | Wilson | |
| 2010/0284806 | A1 * | 11/2010 | Vauchel et al. | 415/214.1 |
| 2010/0296926 | A1 | 11/2010 | Arase et al. | |
| 2011/0020117 | A1 * | 1/2011 | Kondo et al. | 415/182.1 |
| 2012/0093641 | A1 | 4/2012 | Chieco | |
| 2012/0119633 | A1 | 5/2012 | McCarvill | |
| 2012/0125523 | A1 * | 5/2012 | Dupre | 156/98 |
| 2012/0195746 | A1 | 8/2012 | Sarda | |
| 2014/0334922 | A1 * | 11/2014 | Fabre et al. | 415/201 |

FOREIGN PATENT DOCUMENTS

| | | | |
|---|---|---|---|
| EP | 2246544 | A1 | 11/2010 |
| EP | 2455181 | A1 | 5/2012 |
| WO | 9426591 | | 11/1994 |

* cited by examiner

TURBINE CASING WITH SERVICE WEDGE

BACKGROUND OF THE INVENTION

The subject matter disclosed herein relates to turbine casings and, more particularly, to turbine casings with access slots and at least one service wedge configured to be removably installed in the access slots.

Gas and steam turbine engines are typically designed with casing/shell splits along the horizontal centerline of the unit. For major maintenance inspections, parts replacements, etc., the upper half casings are normally removed. The disassembly and subsequent re-assembly process is mechanically very involved along with being resource and time intensive. For example, it is necessary to attach the upper half casing to a crane and to remove fastening elements along the entire axial length of both casing/shell splits so that the crane can lift the upper half casing away from the lower half casing.

For small to medium scale inspection, maintenance, repair or replacement operations, the ability of the operator to access the interior of casings/shells is often compromised. As such, it may be necessary for the entire removal process to be conducted even for relatively minor operations if internal access to parts is required. This issue can be especially resource and time intensive particularly as compared to the scope of the relatively small scale maintenance, repair or replacement operations.

BRIEF DESCRIPTION OF THE INVENTION

According to one aspect of the invention, a turbine casing is provided and includes first and second turbine casing shells configured to be removably coupled to one another. At least one of the first and second turbine casing shells is formed to define an access slot. At least one service wedge is configured to be removably installed in the access slot.

According to another aspect of the invention, a turbine casing is provided and includes a lower turbine casing shell, an upper turbine casing shell configured to be removably coupled to the lower turbine casing shell, the upper turbine casing shell being formed to define at least one access slot symmetrically about a centerline of the upper turbine casing shell and at least one service wedge configured to be removably installed in the at least one access slot.

According to yet another aspect of the invention, a method of accessing a turbine interior is provided. The method includes manually removably installing a service wedge with respect to a turbine casing shell formed to define an access slot in which the service wedge is sized to fit and manually accessing the turbine interior with the service wedge removed from the access slot.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects, the resources and time intensity of inspections, replacement and repair of rotating and/or stationary parts of gas or steam turbine engines can be dramatically reduced. This may be accomplished by employing at least one or more removable wedge segments as relatively small portions of the complete lower or upper casing or shell. The smaller wedge segments can be more efficiently removed than the lower or upper casing or shell during an outage thereby allowing direct operator access to blading for more complete inspections, cleaning or repair than can be achieved via a small diameter (typically 2 cm or less) borescope opening. In addition, with proper foresight the blading can be designed for replacement via the access slots formed for the wedge segments to thereby save valuable outage time, reduce lift requirements and afford more complete inspections with complete removal of the upper casings.

Figure 1:
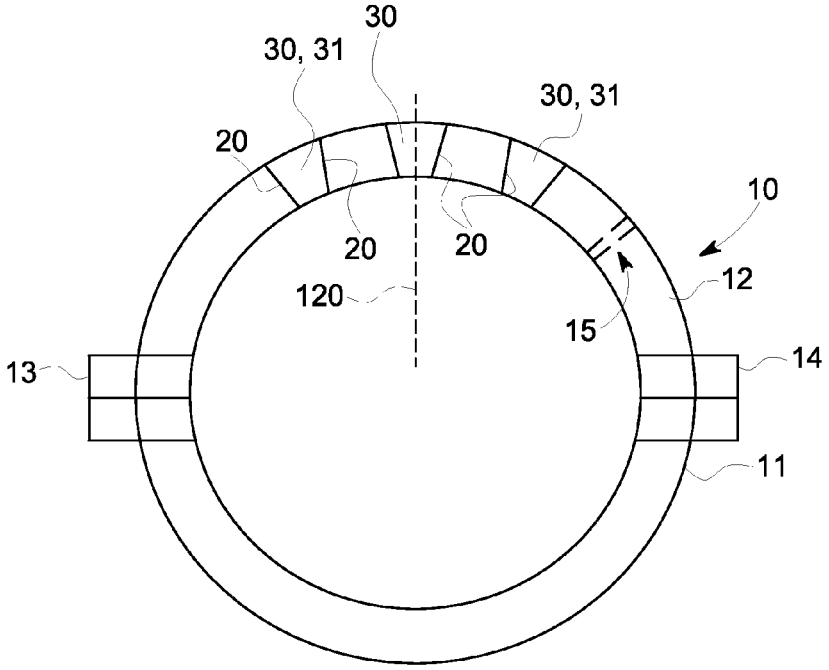
FIG. 1 is an axial view of a turbine casing in accordance with embodiments.
Figure 2:
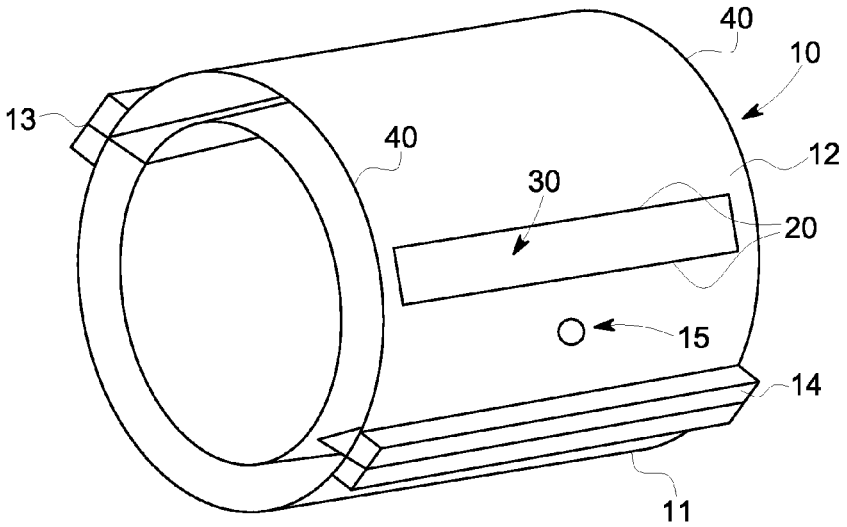
FIG. 2 is a perspective view of the turbine casing of FIG. 1.
Figure 3:
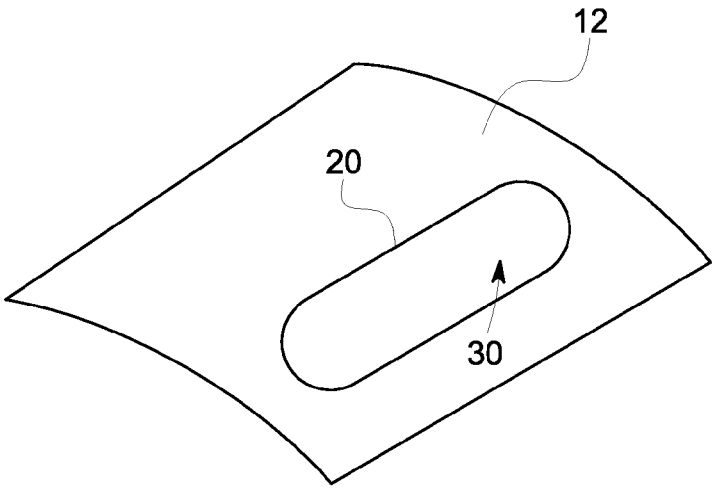
FIG. 3 is a perspective view of the turbine casing in accordance with alternative embodiments.

With reference to FIGS. 1, 2 and 3, a turbine casing 10 is provided. The turbine casing 10 includes a first or lower hemispherical turbine casing shell (hereinafter referred to as "a lower turbine casing shell") 11, a second or upper hemispherical turbine casing shell (hereinafter referred to as "an upper turbine casing shell") 12 and at least one service wedge 30. The upper turbine casing shell 12 is configured to be removably coupled to the lower turbine casing shell 11 by fastening elements arrayed along horizontal joints 13 and 14. The process of removably coupling the upper turbine casing shell 12 to the lower turbine casing shell 11 is resource and time intensive and conducted by initially attaching the upper turbine casing shell 12 to a crane specifically designed for lifting turbine casing shell parts. The process further includes removing each of the fastening elements along the entire axial length of the horizontal joints 13 and 14 so that the upper turbine casing shell 12 can be lifted from the lower turbine casing shell 11.

In some conventional cases, it is not necessary to remove the upper turbine casing shell 12 from the lower turbine casing shell 11 in order to conduct normal inspection and repair operations. In such cases, access to the interior of the turbine casing 10 may be provided via a small (i.e., 2 cm or less) borescope opening 15 that may be formed in the upper turbine casing shell 12. During turbomachine operational modes, the borescope opening 15 is closed by a closure element that is threadably secured in the borescope opening 15. Thus, the closure element may be removed from the borescope opening 15 by rotation of the closure element about the radial dimension. As such, due to both ease of manufacture and the curvature of the turbine casing 10, the borescope opening 15 is typically circular and a diameter thereof is required to be maintained at a relatively small scale to reduce stress concentrations on the casing and so that the closure element can register with the threading. Also, the borescope opening 15 need not be larger than the small-diameter borescope itself to avoid unnecessarily reducing the structural strength of the turbine casing 10.

Since the diameter of the borescope opening 15 is small, it is generally not possible to conduct complete inspection and repair operations that require greater access to a turbomachine interior than what is provided via the borescope opening 15 (i.e., small to intermediate scale inspections and repairs) without removing the upper turbine casing shell 12 from the lower turbine casing shell. Consequently, small to intermediate scale inspections and repairs are often associated with outsized costs and turbomachine 10 downtime associated with the resource and time intensive removal process described above. Accordingly, at least one of the upper and lower turbine casing shells 12 and 11 is formed to define an access slot 20 in which the service wedge 30 is sized to fit. The service wedge 30 can therefore be removably installed with respect to the access slot 20 by manual procedures that can be executed quickly or at least more quickly than the full upper turbine casing shell 12 removal process described above.

In accordance with aspects, the manual procedures may be conducted with assistance from hoists or cranes that are generally smaller than those used for full casing shell removal. As the upper and lower turbine casing shells 12 and 11 can weigh several tons, the hoists or cranes needed for full removal must have the capability of lifting several tons or more. By contrast, the hoists or cranes that may be required to assist in the removal of the service wedge need to be capable of lifting substantially less weight (e.g., on the order of several hundred pounds or less).

During turbomachine operations, the service wedge 30 is installed in the access slot 20. The service wedge 30 can be removed from the access slot 20 to allow for small to intermediate scale inspections and repairs without otherwise removing the entire upper turbine casing shell 12 from the lower turbine casing shell 11. The access slot 20 thus provides for less costly repairs and inspections and less turbomachine downtime as well.

Although the access slot 20 may be defined by one or both of the upper and lower turbine casing shells 12 and 11, the following description will relate to the exemplary case of the access slot 20 being defined by the upper turbine casing shell 12. This is being done for clarity and brevity and is not intended to otherwise limit the scope of the application or the claims.

In accordance with embodiments, the access slot 20 may be defined by the upper turbine casing shell 12 to have a circumferential arc-length of adequate dimensions to allow access to and/or removal of specific internal components yet remain sized for fast and efficient removal. Even if the access slot 20 extends along substantially an entire axial length of the turbine casing 10 (e.g., from forward flange 40 to aft flange 41), the access slot 20 may have a relatively short arc-length and thereby allow the corresponding service wedge 30 to remain correspondingly lightweight. As the service wedge 30 is configured to be removably installed in the access slot 20 by manual procedures (with or without receiving some assistance from the aforementioned hoists or cranes), the lightweight characteristic of the service wedge 30 permits the service wedge 30 to be lifted out of the access slot 20 manually or by use of the relatively small hoists or cranes.

Of course, it is to be understood that the illustrations of the access slot 20 in the figures are merely exemplary and that other larger and smaller access slot 20 shapes and sizes may be employed as long as the corresponding service wedge 30 is sufficiently lightweight to be quickly and efficiently removable by manual or hoist/crane assisted procedures. In addition, although the access slot 20 is illustrated as having a regular shape, it is to be understood that this is not necessary and that it is possible that the access slot 20 may have a regular, irregular, angled, rounded or otherwise complex shape as shown in FIG. 3.

The access slot 20 may be defined along a centerline 120 of the upper turbine casing shell 12 or at an offset position relative to the centerline 120. In either case, the access slot 20 may be but is not required to be defined symmetrically about the centerline 120 to thereby preserve thermal expansion and contraction characteristics of the turbine casing 10. In the case where the access slot 20 is defined at the offset position, the access slot 20 may be defined as multiple access slots 20. In this case, one of the access slots 20 may be defined at a first offset position relative to the centerline 120 and another access slot 20 may be defined at a second offset position on the opposite side of the centerline 120 from the first offset position. In accordance with embodiments, the first and second offset positions may be defined at or near flexural nodal locations (e.g., the 1:30 and 10:30 positions, respectively) of the upper turbine casing shell 12.

In the case where the upper turbine casing shell 12 defines multiple access slots 20, the service wedge 30 may be provided as multiple service wedges 30 and/or multiple dummy wedges 31. In either case, each one of the multiple service wedges 30 or dummy wedges 31 is configured to be removably installed in a corresponding one of the multiple access slots 30.

Figure 4:
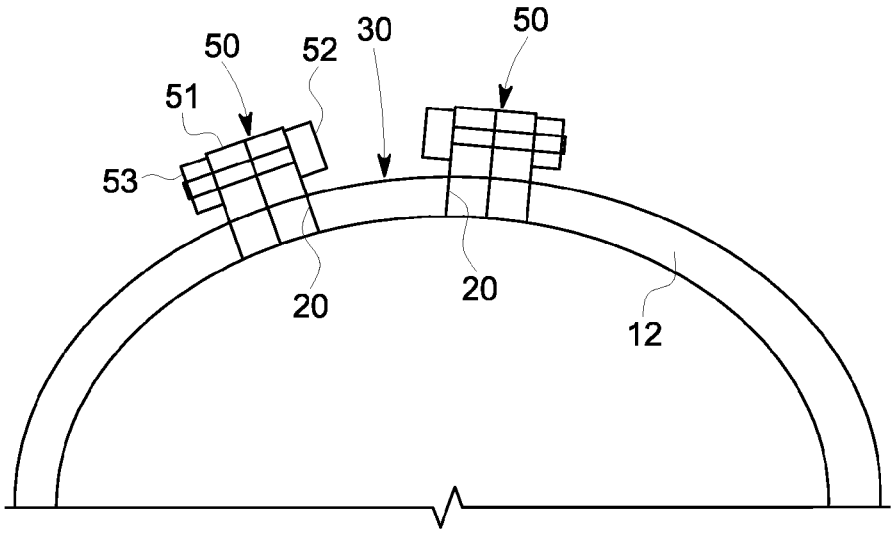
FIG. 4 is an enlarged axial view of a portion of the turbine casing of FIG. 1 and a service wedge.

With reference to FIG. 4 and, in accordance with embodiments, the service wedge 30 may be secured in the access slot 20 by wedge fastening elements 50. The wedge fastening elements 50 include flanges 51 extending from corresponding long-edge portions of both the upper turbine casing shell 12 and the service wedge 30 and combinations of bolts 52 and nuts 53. The bolts 52 extend through through-holes defined in the flanges 51 and threadably engage with the nuts 53 to secure the flanges 51 together and to thereby secure the service wedge 30 in the access slot 20.

Although the flanges 51 are illustrated in FIG. 4 as extending in the axial dimension along the corresponding long-edge portions of the upper turbine casing shell 12 and the service wedge 30, it is to be understood that this configuration is not required and that other arrangements are possible. For example, the flanges 51 could be arranged along the long-edge portions, the short-edge portions or both the long and short-edge portions. In any case, a number of the bolt/nut combinations may be maintained below a predefined number as long as the service wedge 30 can be secured in the access slot 20 so that the time required to remove the service wedge 30 can remain desirably short. In accordance with embodiments, the bolt/nut combinations may be arranged so that the bolts 52 extend along the axial or circumferential dimensions (as opposed to the radial dimension).

Figure 5:
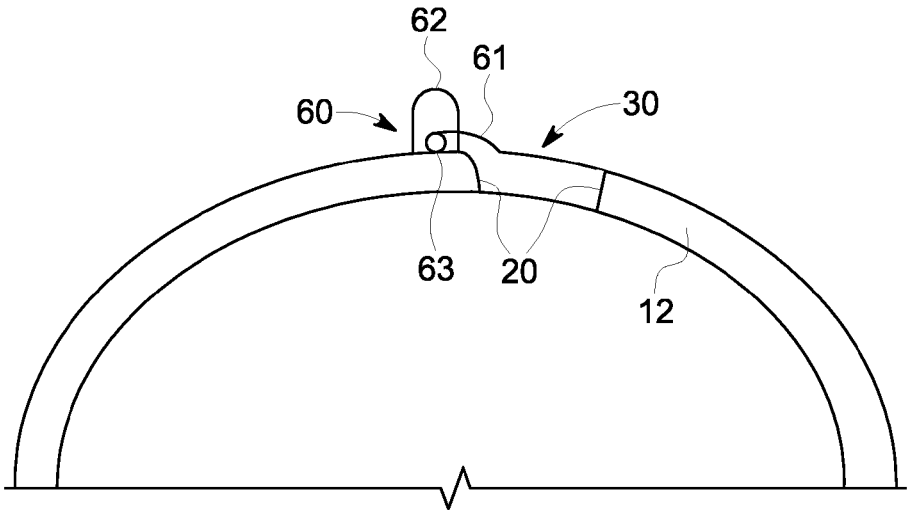
FIG. 5 is an axial view of a service wedge with a hinge.

With reference to FIG. 5, the service wedge 30 may be hingeably coupled to the upper turbine casing shell 12 via hinge assembly 60. For example, the service wedge 30 may include hinge arm 61 that projects radially outwardly and circumferentially from a side of the service wedge 30 while the upper turbine casing shell 12 may include a guide element 62. A boss or hinge-pin 63 may be disposed to extend through the hinge arm 61 and the guide element 62. In such a case, the service wedge 30 can be removed from the access slot 20 by removing any fastening elements in use and then withdrawing the service wedge 30 radially outwardly until the hinge-pin 63 reaches the distal end of the guide element 62. At this point, the service wedge 30 can be pivoted around the hinge-pin 63 to complete the service wedge 30 removal process.

In accordance with further embodiments, it is to be understood that the borescope opening 15 may not be required where the access slot 20 is formed. In such cases, the borescope may simply by snaked through the access slot 20 with the service wedge 30 removed. If the borescope is required to be secured in place, appropriate tooling may be provided to do so within the scope of this disclosure.

Figure 6:
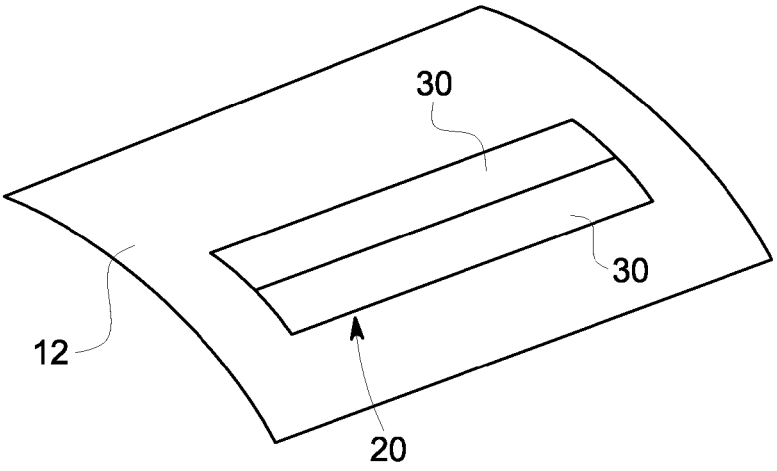
FIG. 6 is a schematic perspective view of multiple service wedges in accordance with embodiments.
Figure 7:
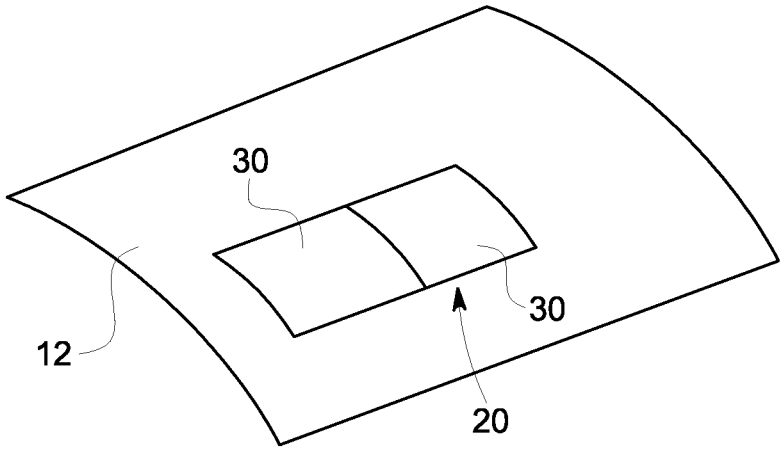
FIG. 7 is a schematic perspective view of multiple service wedges in accordance with alternative embodiments.
Figure 8:
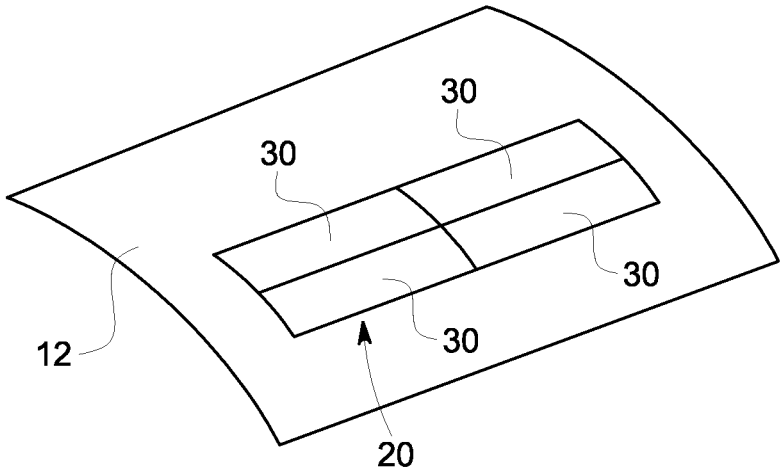
FIG. 8 is a schematic perspective view of multiple service wedges in accordance with further alternative embodiments.

With reference to FIGS. 6-8 and, in accordance with further embodiments, multiple service wedges 30 may be removably installed in a single access slot 20. In such cases, the multiple service wedges 30 may be removed as a single unit or one at a time by manual procedures similar to the procedures described above. The use of multiple service wedges 30 in a single access slot 20 may permit greater flexibility in access slot 20 sizing as well as greater flexibility in service procedures. That is, for a given service requiring limited access, only one of the multiple service wedges 30 may be removed while all of the multiple service wedges 30 may be removed for more substantial services procedures.

Although FIG. 6 illustrates the multiple service wedges 30 being arranged in the access slot 20 in the circumferential dimension, it is to be understood that this is not required and that the multiple service wedges 30 can be arranged in other dimensions. For example, the multiple service wedges 30 may be arranged in the circumferential dimension (i.e., in a 2×1 matrix, see FIG. 6), in the axial dimension (i.e., in a 1×2 matrix, see FIG. 7) or in the axial and circumferential dimensions (i.e., in a 2×2 matrix, see FIG. 8).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine casing, comprising:

first and second turbine casing shells configured to be removably coupled to one another, at least one of the first and second turbine casing shells being formed to define an access slot; and at least one service wedge configured to be removably installed in the access slot, wherein the at least one of the first and second turbine casing shells is formed to define multiple access slots and the at least one service wedge comprises multiple service wedges, each one of the multiple service wedges being configured to be removably installed in a corresponding one of the multiple access slots.

2. The turbine casing according to claim 1, wherein the first turbine casing shell comprises a lower hemispherical casing and the second turbine casing shell comprises an upper hemispherical casing and is formed to define the access slot.

3. The turbine casing according to claim 1, wherein the access slot is defined along a centerline of the at least one of the first and second turbine casing shells.

4. The turbine casing according to claim 1, wherein a position of the access slot is defined such that the access slot is offset from a centerline of the at least one of the first and second turbine casing shells.

5. The turbine casing according to claim 1, wherein the multiple access slots are arranged symmetrically relative to a centerline of the at least one of the first and second turbine casing shells.

6. The turbine casing according to claim 1, wherein the access slot is elongate in an axial dimension of at least one of the first and second turbine casing shells.

7. The turbine casing according to claim 1, wherein multiple service wedges are configured to be removably installed in the access slot.

8. The turbine casing according to claim 7, wherein the multiple service wedges are arranged in one or more of circumferential and axial dimensions of the turbine casing.

9. A turbine casing, comprising:

a lower turbine casing shell;

an upper turbine casing shell configured to be removably coupled to the lower turbine casing shell, the upper turbine casing shell being formed to define at least one access slot symmetrically about a centerline of the upper turbine casing shell; and at least one service wedge configured to be removably installed in the at least one access slot, wherein the upper turbine casing shell is formed to define multiple access slots symmetrically about the centerline and the at least one service wedge comprises multiple service wedges, each one of the multiple service wedges being configured to be removably installed in a corresponding one of the multiple access slots.

10. The turbine casing according to claim 9, wherein the at least one access slot is elongate in an axial dimension of the upper turbine casing shell.

11. The turbine casing according to claim 9, wherein multiple service wedges are configured to be removably installed in the at least one access slot.

12. The turbine casing according to claim 11, wherein the multiple service wedges are arranged in one or more of circumferential and axial dimensions of the turbine casing.

13. The turbine casing according to claim 9, wherein the at least one service wedge is hingeably coupled to the upper turbine casing shell.

14. A method of accessing a turbine interior, comprising:

manually removably installing a service wedge with respect to a turbine casing shell formed to define an access slot in which the service wedge is sized to fit; and manually accessing the turbine interior with the service wedge removed from the access slot, further comprising forming the access slot substantially symmetrically about the turbine casing shell, and wherein the forming of the access slot comprises forming multiple access slots and the service wedge is provided as multiple service wedges that are respectively receivable in a corresponding one of the multiple access slots wherein the forming of the multiple access slots comprises forming the multiple access slots symmetrically relative to a centerline of the turbine casing shell.

* * * * *